US006918158B2

(12) United States Patent
Isele

(10) Patent No.: US 6,918,158 B2
(45) Date of Patent: Jul. 19, 2005

(54) HINGE

(75) Inventor: Herbert Isele, Lustenau (AT)

(73) Assignee: Julius Blum Gesellschaft m.b.H., Höchst (AT)

( * ) Notice: Subject to any disclaimer, the term of this patent is extended or adjusted under 35 U.S.C. 154(b) by 19 days.

(21) Appl. No.: 10/395,108

(22) Filed: Mar. 25, 2003

(65) Prior Publication Data

US 2004/0163212 A1 Aug. 26, 2004

(30) Foreign Application Priority Data

Feb. 21, 2003 (AT) ..... 108/2003 U

(51) Int. Cl.[7] ..... E05D 7/04

(52) U.S. Cl. ..... 16/235; 16/240; 16/242; 16/258

(58) Field of Search ..... 16/258, 254, 246, 16/382, 235, 236–239, 240–245, 265, 351, 271, DIG. 43, 272; 403/322.4, 314, 320

(56) References Cited

U.S. PATENT DOCUMENTS

| | | | | | |
|---|---|---|---|---|---|
| 4,590,641 | A | * | 5/1986 | Lautenschlager et al. | 16/238 |
| 4,800,622 | A | * | 1/1989 | Rock et al. | 16/240 |
| 4,908,907 | A | * | 3/1990 | Rock et al. | 16/240 |
| 5,036,565 | A | * | 8/1991 | Salice | 16/358 |
| 5,210,907 | A | * | 5/1993 | Toyama | 16/258 |
| 5,224,242 | A | * | 7/1993 | Marjanovic | 16/258 |
| 5,603,142 | A | * | 2/1997 | Dubach et al. | 16/247 |
| 5,781,966 | A | * | 7/1998 | Ferrari et al. | 16/242 |
| 5,920,958 | A | * | 7/1999 | Domenig et al. | 16/237 |
| 5,930,866 | A | * | 8/1999 | Rupprechter | 16/242 |
| 5,964,010 | A | * | 10/1999 | Huber | 16/237 |
| 6,032,333 | A | * | 3/2000 | Brustle | 16/242 |
| 6,061,872 | A | * | 5/2000 | Albrecht et al. | 16/258 |
| 6,266,848 | B1 | * | 7/2001 | Fraccaro et al. | 16/245 |
| 6,418,589 | B1 | * | 7/2002 | Salice | 16/258 |
| 6,442,798 | B1 | * | 9/2002 | Rupprechter | 16/242 |
| 6,470,531 | B2 | * | 10/2002 | Domenig et al. | 16/240 |
| 6,553,621 | B2 | * | 4/2003 | Isele | 16/238 |
| 6,698,062 | B2 | * | 3/2004 | Egger et al. | 16/242 |

FOREIGN PATENT DOCUMENTS

| | | | |
|---|---|---|---|
| AT | 005924 U1 | | 1/2003 |
| GB | 2116627 A | * | 9/1983 |

* cited by examiner

*Primary Examiner*—Robert J. Sandy
*Assistant Examiner*—Andre' L. Jackson
(74) *Attorney, Agent, or Firm*—Wenderoth, Lind & Ponack, L.L.P.

(57) ABSTRACT

A hinge (2) is used for furniture having a frame (3) and with a door wing (1) secured to the frame (3). The hinge (2) has a bedplate (5) to be fitted to the frame (3), which bedplate carries a hinge arm (7), and a joint-adjustment screw (24). The hinge arm (7) is provided directly on the bedplate (5), the bedplate (5) and the hinge arm (7) being connected to each other by a common axle (22). Furthermore, the hinge arm (7) is able to be tilted relative to the bedplate (5) by the joint-adjustment screw (24), which is held in the hinge arm (7). The hinge arm (7) is able to be moved in the direction of the depth of the item of furniture by means of an eccentric (37) or a spiral disk (29).

17 Claims, 6 Drawing Sheets

HINGE

BACKGROUND OF THE INVENTION

The invention relates to a hinge for furniture with a frame and with a door wing secured to the frame, with a bedplate which is to be fitted to the frame and which carries a hinge arm, and with a joint-adjustment screw.

In modern furniture construction, so-called door frames are sometimes used, these frames, as a stable part of the item of furniture, carrying the hinges for a door wing. The actual side walls of the body of the furniture are made from weaker material. This brings with it the advantage that either the overall costs of the item of furniture can be reduced, or higher-quality and thus optically more attractive materials can be chosen for the side walls without the furniture thereby becoming substantially more expensive.

Such a hinge is known for example from the Austrian utility model AT 1385 U1.

SUMMARY OF THE INVENTION

The object of the invention is to improve a hinge of this type such that a simple adjustment of the hinge arm and thus of the door wing in three dimensions is possible without an additional intermediate piece having to be provided at the hinge.

The object according to the invention is achieved in that the hinge arm is housed directly on the bedplate, the bedplate and the hinge arm being connected to each other by a common axle, and the hinge arm being able to be tilted relative to the bedplate by means of the joint-adjustment screw and able to be moved in the direction of the depth of the item of furniture by means of an eccentric.

BRIEF DESCRIPTION OF THE DRAWINGS

Two embodiments of the invention are described below with reference to the figures of the attached drawings.

DETAILED DESCRIPTION OF THE PREFERRED EMBODIMENTS

Figure 1:
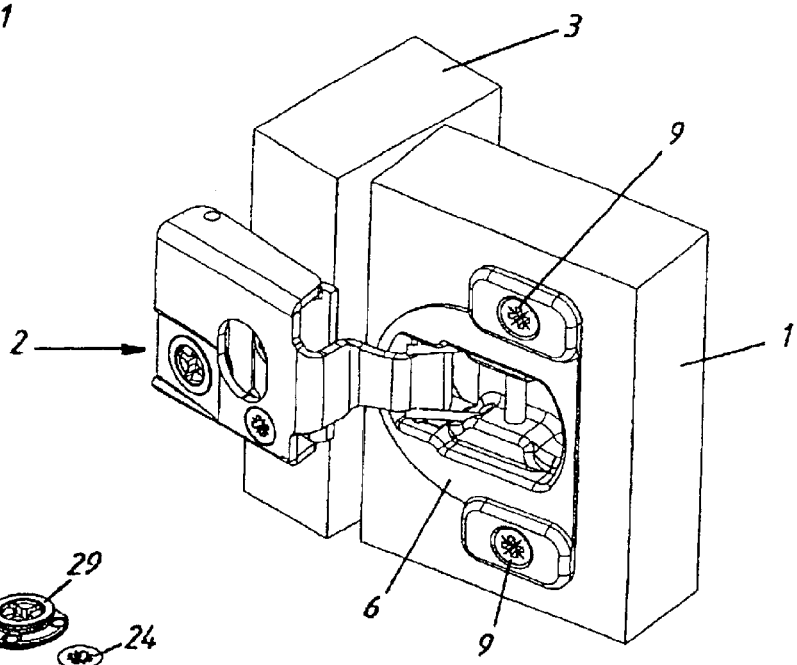
FIG. 1 shows a perspective view of a hinge according to the invention in a mounting position, wherein sections of a frame and of the door wing are shown.
Figure 2:
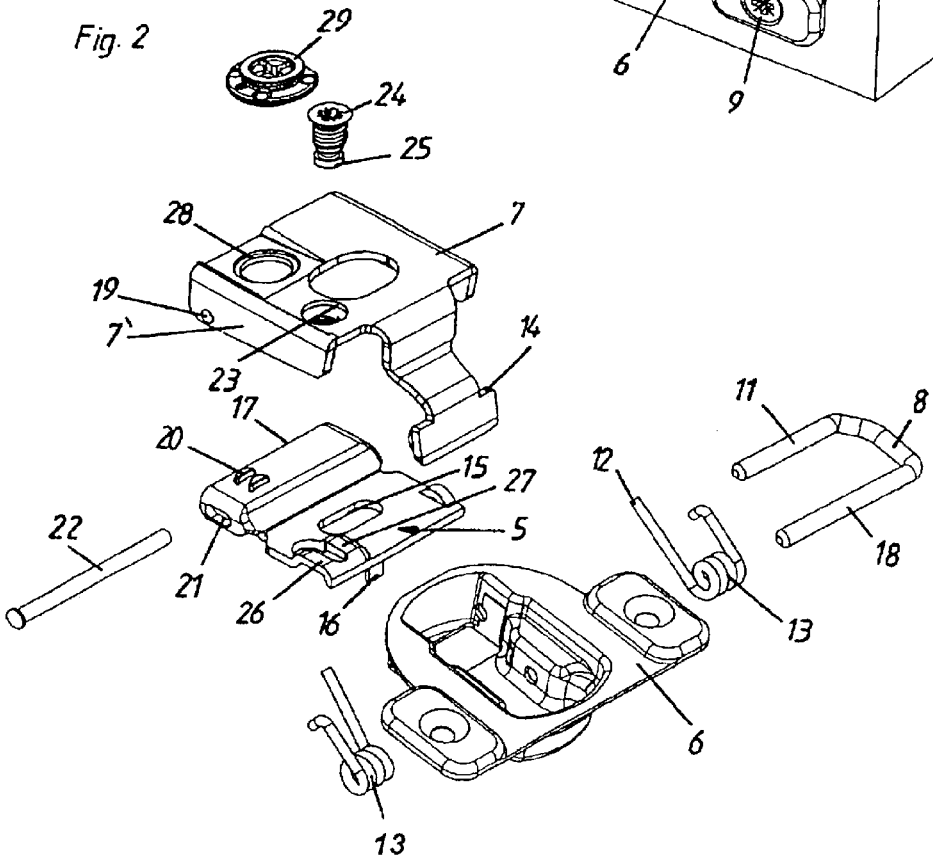
FIG. 2 shows an exploded perspective view of a hinge according to the invention.

In FIG. 1, a door wing 1 is shown in the open position. A hinge 2 connects the door wing 1 to a frame 3 of the body of the item of furniture.

According to the embodiment of FIGS. 1 to 5, the hinge 2 consists of a bedplate 5, a hinge arm 7 and a hinge casing 6 on the door wing side. The hinge arm 7 is provided on the bedplate 5. The hinge casing 6 is articulated to the hinge arm 7 by means of a hinge axle. The hinge axle is formed by one leg 11 of a U-stirrup 8.

The hinge casing 6 is inserted into a bore in the door wing 1 in a mounting position and screwed to the door wing 1 by means of screws 9.

Two legged springs 13, which exert a closure force, are housed at the hinge casing 6. The legged springs 13 are housed on the second leg 18 of the U-stirrup 8.

The legs 12 of the legged springs 13 press on a control part 14 which is developed at the free end of the hinge arm 7. The hinge casing 6 is held in the closure position by the legged springs 13, or pulled into the closure position if the angle between the door wing 1 and the closure plane is very small.

The bedplate 5 is housed directly against the frame 3 and is screwed to the frame 3 by means of a screw 4 which projects through an oblong hole 15 of the bedplate 5. On the side facing the door wing 1, the bedplate 5 has an angled projection 16 which rests against the frame 3 at the front in the mounting position.

At the rear of the frame 3, the bedplate 5 is provided with a base 17. The hinge arm 7 is developed with a U-shaped cross-section, with side bars 7' of the hinge arm 7 pointing towards the bedplate 5. The side bars 7' of the hinge arm 7 have holes 19 which are designed as bores or punched holes. The side walls of the base 17 of the bedplate 5 have oblong holes 21. The hinge arm 7 is articulated to the bedplate 5 by means of an axle 22 which projects through the holes 19, 21.

The hinge arm 7 is also provided with a nut thread 23 in which a joint-adjustment screw 24 is housed. The joint-adjustment screw 24 engages with its head 25 behind a stirrup 26 punched out from the bedplate 5, the screw projecting through an oblong hole 27, open to the rear, in the stirrup 26.

A spiral disk 29, forming an eccentric, is housed in a rear opening 28 of the hinge arm 7. A spiral projection 10 of the spiral disk 29 lies against tooth-like projections 20 of the bedplate 5 in mounting position. The projections 20 are developed at the base 17 of the bedplate 5.

If the position of the door wing 1 is to be adjusted in the direction of the furniture joint, the joint-adjustment screw 24 is turned and thus the hinge arm 7 is tilted about the axle 22.

In order to adjust the position of the door wing 1 in the direction of the depth of the item of furniture, a turning of the spiral disk 29 is sufficient. In the process, the hinge arm 7 can be moved over the length of the oblong holes 21.

The height setting of the door wing 1 takes place by loosening the fixing screw 4 projecting through the oblong hole 15 and then moving the whole hinge 2, the fixing screw 4 being tightened again once height positioning has taken place.

Figure 3:
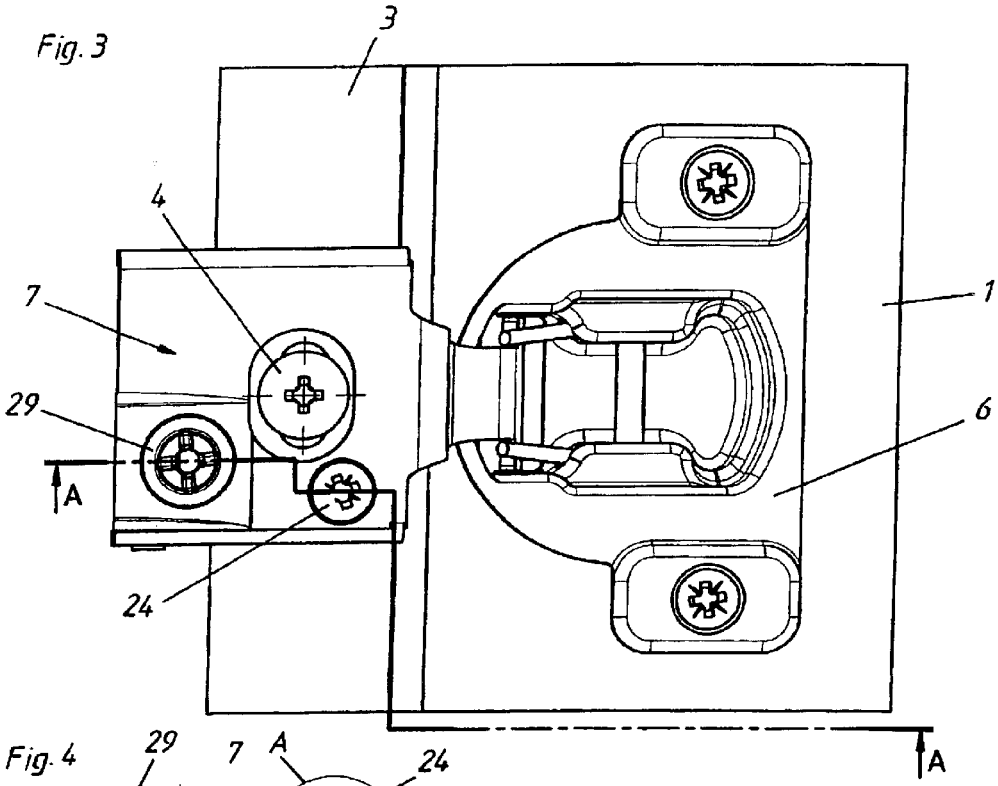
FIG. 3 shows a top view of a hinge according to the invention.
Figure 4:
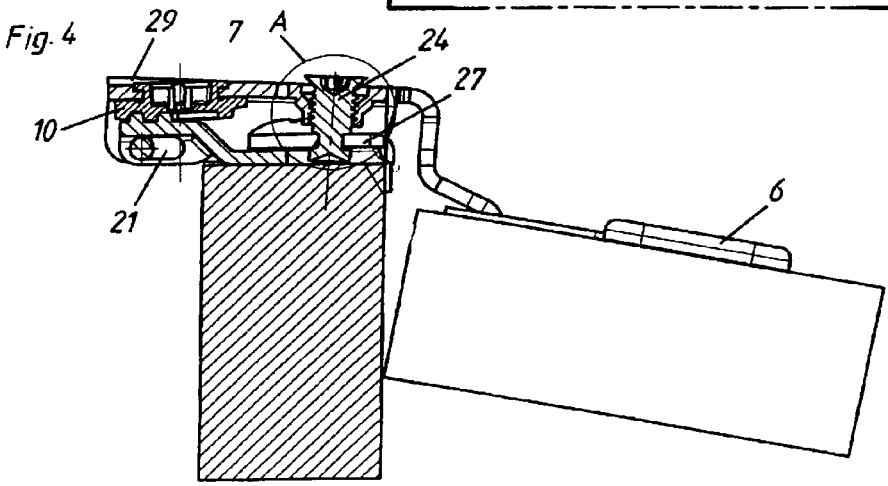
FIG. 4 shows a section along line A—A of FIG. 3.
Figure 5:
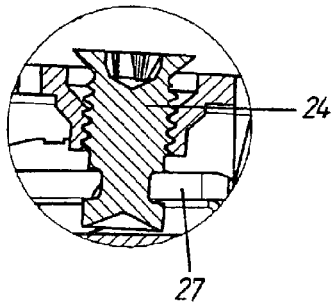
FIG. 5 shows a cut-out section A of FIG. 4.
Figure 6:
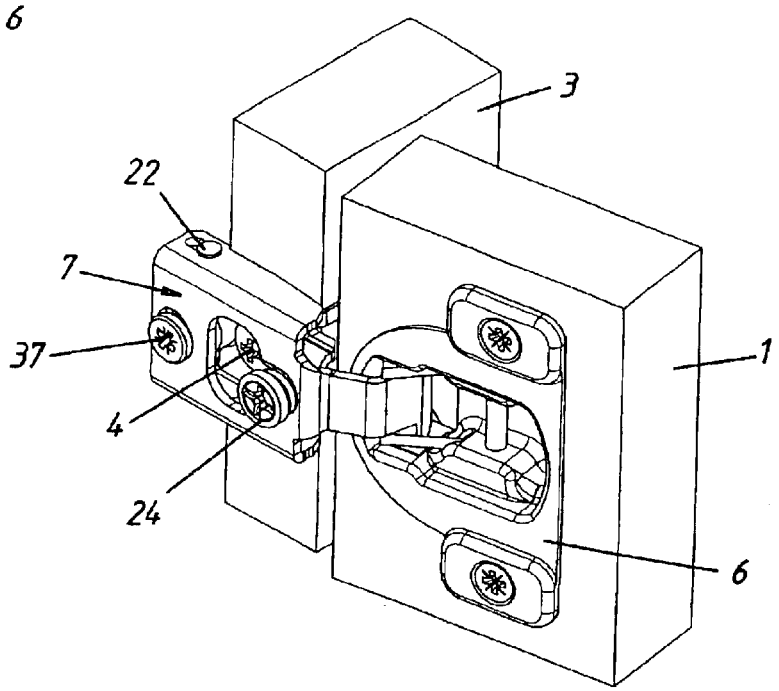
FIG. 6 shows a perspective view of another embodiment of a hinge according to the invention in a mounting position, wherein sections of the frame and of the door wing are shown.
Figure 7:
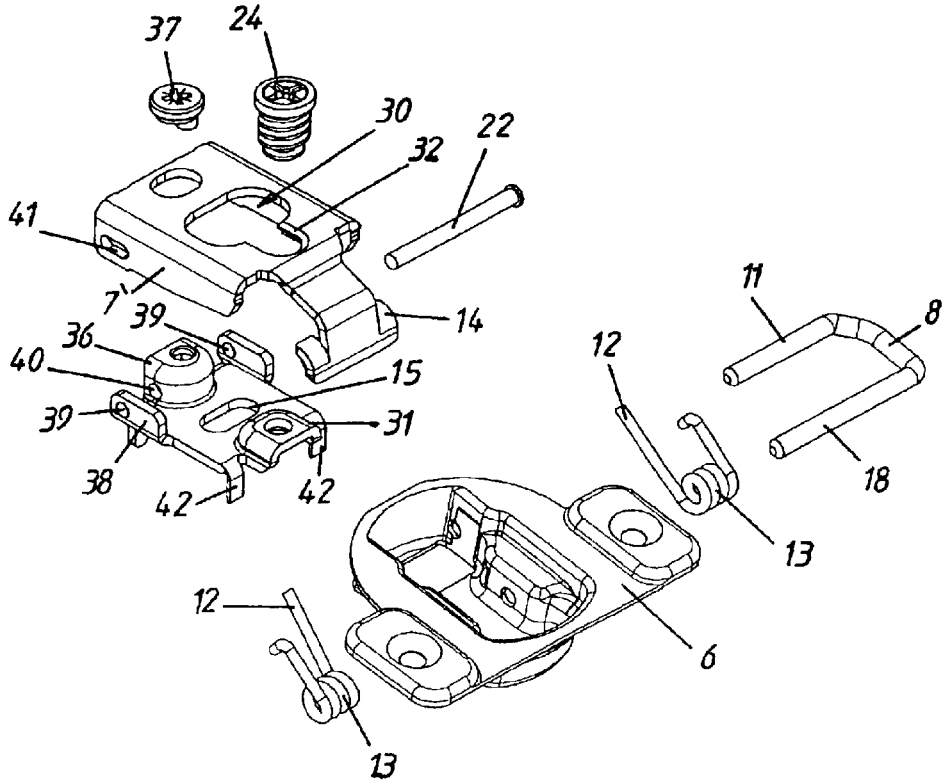
FIG. 7 shows an exploded perspective view of a hinge according to the embodiment of FIG. 6.
Figure 8:
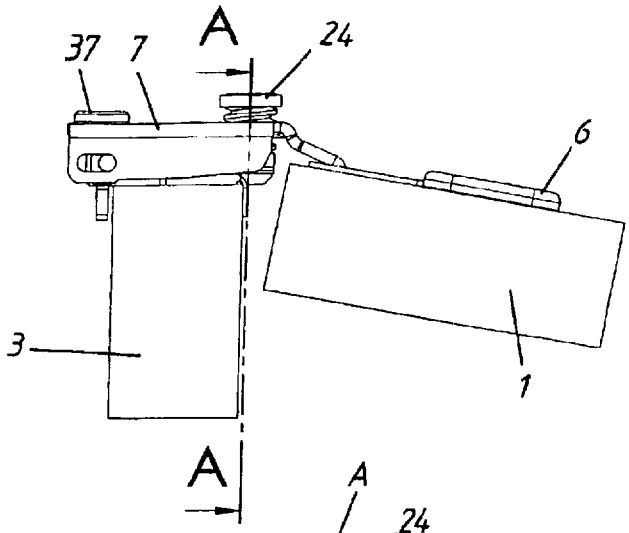
FIG. 8 shows a side view of a hinge according to the invention, wherein sections of the frame and of the door wing are shown.
Figure 9:
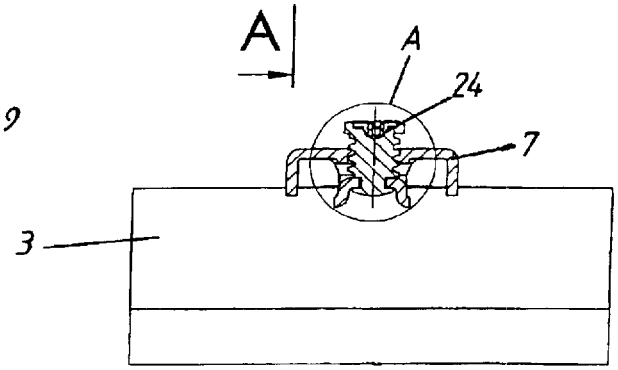
FIG. 9 shows a section along line A—A of FIG. 8.
Figure 10:
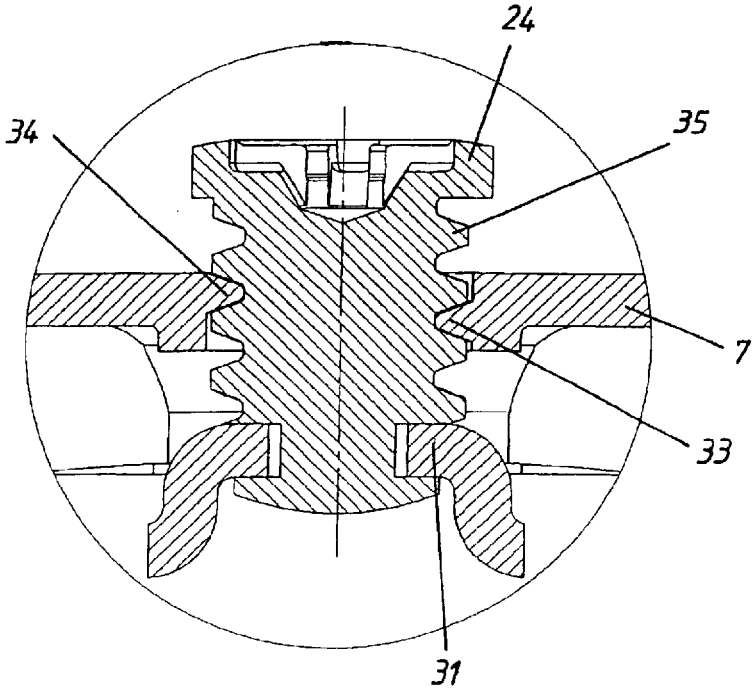
FIG. 10 shows a cut-out section A of FIG. 9.
Figure 11:
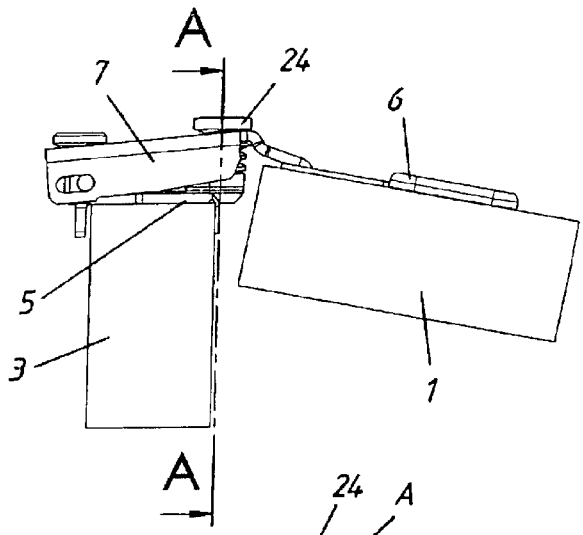
FIG. 11 shows a side view of a hinge according to the invention after joint adjustment has taken place.
Figure 12:
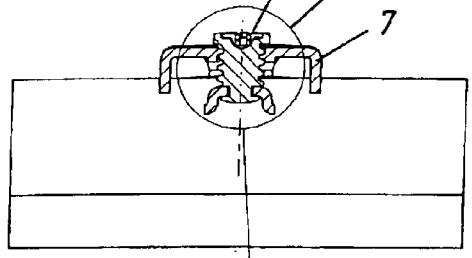
FIG. 12 shows a section along line A—A of FIG. 11.
Figure 13:
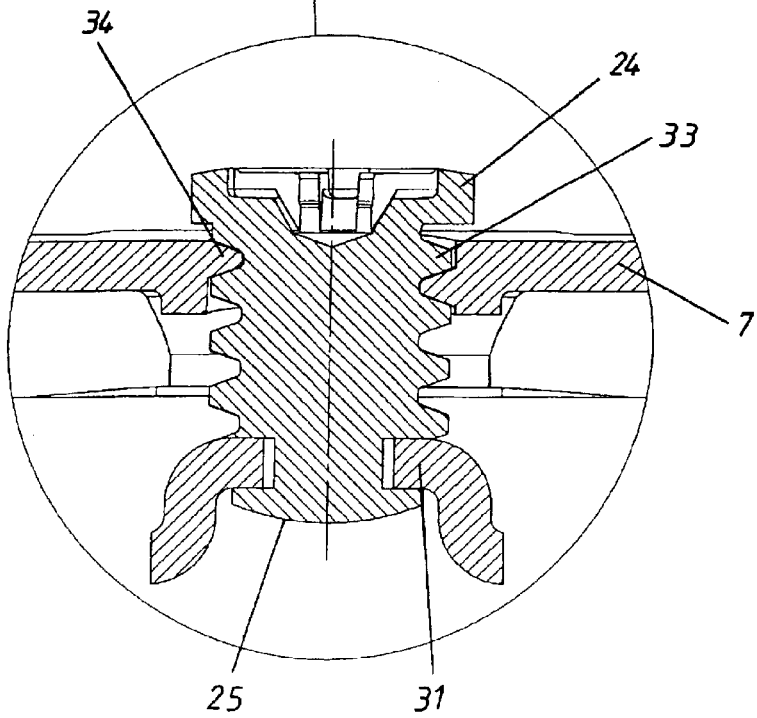
FIG. 13 shows a cut-out section A of FIG. 12.
Figure 14:
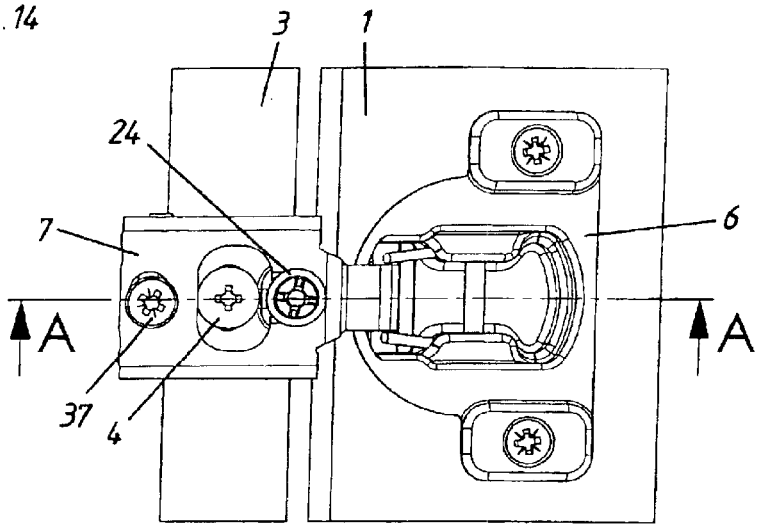
FIG. 14 shows a top view of a hinge according to the invention.
Figure 15:
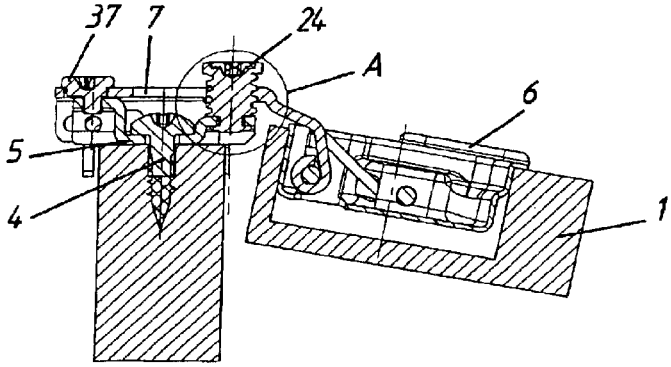
FIG. 15 shows a section along line A—A of FIG. 14.
Figure 16:
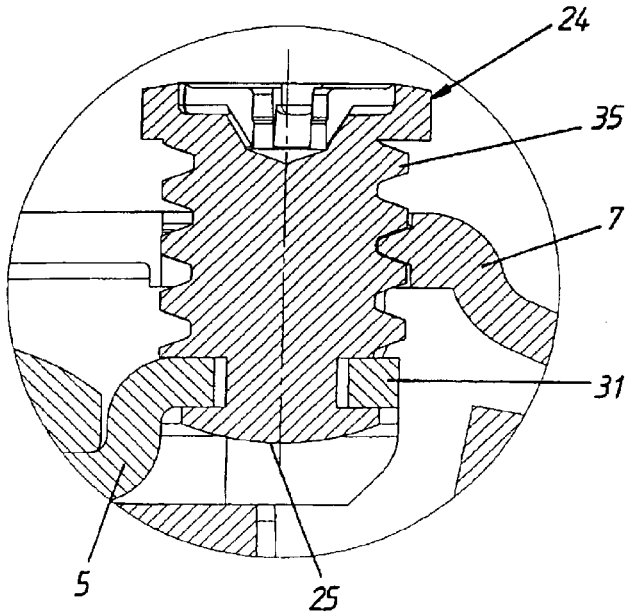
FIG. 16 shows a cut-out section A of FIG. 15.

As can be seen, for example, by looking at the figures, particularly FIG. 3, the joint adjustment screw 24 and the spiral disk 29 are laterally offset with respect to a central plane of the hinge arm 7, the central plane being perpendicular to the axis of rotation of the hinge.

In the embodiment according to FIGS. 6 to 16, the hinge 2 again consists of a bedplate 5, a hinge arm 7 and a hinge casing 6. The hinge casing 6 is again articulated to the hinge arm 7 by means of an axle which is formed by one leg 11 of a stirrup 8. Springs 13 which are housed on the second leg 18 of the stirrup 8 press with their legs on a control part 14 at the free end of the hinge arm 7. This structure corresponds to the previous embodiment.

The hinge arm 7 has a keyhole 30, and the bedplate 5 a stirrup 31 in which the head 25 of the joint-adjustment screw 24 is riveted. The threaded section of the joint-adjustment screw 24 projects through an oblong hole 32, open to the rear, which forms a narrower section of the keyhole 30.

Opposite-facing rims 33, 34 of the oblong hole 32 engage in thread 35 of the joint-adjustment screw 24. In order to facilitate this, the rims 33, 34 are offset relative to each other in the longitudinal direction of the joint-adjustment screw 24.

In the rear region of the bedplate 5, a base 36 is again provided in which this time an eccentric 37 is housed. The bedplate 5 has side bars 38 angled upwards, i.e. in the direction of the hinge arm 7, in which side bar holes 39 are provided. The holes 39 are aligned with holes 40 in the base 36.

The side bars 7' of the hinge arm 7 are provided with oblong holes 41.

An axle 22 projects through the holes 39, 40 and through the oblong holes 41 and thus connects the hinge arm 7 to the bedplate 5. The axle 22, connecting the hinge arm 7 and the bedplate 5, and an axis of rotation of the eccentric 27, lie in one plane.

The bedplate 5 has angled bars 42 at the front which rest against the front of the frame 3 in the mounting position.

The adjustment of the hinge 2 takes place as in the case of the previously described embodiment. If the position of the door wing 1 is to be adjusted in the direction of the furniture door joint, the joint-adjustment screw 24 is turned and the hinge arm 7 is thus titled about the axle 22.

In order to adjust the position of the door wing 1 in the direction of the depth of the item of the furniture, a turning of the eccentric 37 is sufficient. In the process, the hinge arm 7 can be moved by the length of the oblong holes 41 in its side bars 7'.

The height setting of the door wing 1 again takes place by loosening of the fixing screw 4 projecting through the oblong hole 15 and then moving of the whole hinge 2, the fixing screw 4 being tightened again once height positioning has taken place.

What is claimed is:

1. A hinge for an item of furniture having a frame and a door wing secured to the frame, comprising:

a bedplate to be fitted to the frame;

a hinge arm carried by said bedplate, said hinge arm being provided directly on said bedplate;

a common axle connecting said bedplate and said hinge arm;

a joint adjustment screw operable to tilt said hinge arm relative to said bedplate about said common axle; and an eccentric operable to move said hinge arm in a depth direction of the item of furniture.

2. The hinge arm of claim 1, wherein said common axle connecting said hinge arm and said bedplate and an axis of rotation of said eccentric lie in one plane.

3. The hinge arm of claim 1, wherein said eccentric is housed in said bedplate.

4. The hinge of claim 1, wherein said eccentric is housed in a base of said bedplate, said common axle projecting through said base.

5. The hinge of claim 1, wherein said common axle projects through oblong holes in said hinge arm.

6. The hinge of claim 1, wherein said common axle projects through oblong holes in said bedplate.

7. The hinge of claim 1, wherein said common axle projects through round holes in said bedplate and through oblong holes in said hinge arm.

8. The hinge arm of claim 1, wherein said joint adjustment screw is riveted in said bedplate.

9. The hinge of claim 1, wherein said joint adjustment screw is positioned in a nut thread of said hinge arm.

10. The hinge of claim 1, wherein said bedplate has an oblong hole for receiving a fixing screw, said oblong hole being aligned vertically in a mounting position of said bedplate.

11. The hinge of claim 1, wherein said hinge is a single-axle hinge.

12. The hinge of claim 1, wherein said eccentric comprises a spiral disk.

13. The hinge of claim 12, wherein said spiral disk is housed in said hinge arm and has a spiral projection resting against at least one projection of said bedplate.

14. The hinge of claim 12, wherein said joint adjustment screw and said spiral disk are laterally offset with respect to a central plane of said hinge arm, the central plane being perpendicular to an axis of rotation of said hinge.

15. The hinge of claim 1, wherein said joint adjustment screw has a head anchored in said bedplate and projects through an oblong hole in said hinge arm and wherein opposite-facing rims of said oblong hole engage in a thread of said joint adjustment screw.

16. The hinge of claim 15, wherein said opposite-facing rims of said oblong hole which engage in the thread of said joint adjustment screw are offset relative to each other in a longitudinal direction of said joint adjustment screw.

17. The hinge of claim 15, wherein said oblong hole forms part of a keyhole in said hinge arm.

* * * * *